US011540625B1

(12) United States Patent
Soho et al.

(10) Patent No.: US 11,540,625 B1
(45) Date of Patent: Jan. 3, 2023

(54) STATIONARY SUPPLIES CASE

(71) Applicants: Edme Soho, Nutley, NJ (US); Michel M. Shaker, Nutley, NJ (US)

(72) Inventors: Edme Soho, Nutley, NJ (US); Michel M. Shaker, Nutley, NJ (US)

( * ) Notice: Subject to any disclaimer, the term of this patent is extended or adjusted under 35 U.S.C. 154(b) by 11 days.

(21) Appl. No.: 17/012,983

(22) Filed: Sep. 4, 2020

(51) Int. Cl.
*A47B 97/04* (2006.01)
*A47B 23/04* (2006.01)
*A45C 11/34* (2006.01)
*A47B 23/06* (2006.01)

(52) U.S. Cl.
CPC ..... *A47B 23/043* (2013.01); *A45C 11/34* (2013.01); *A47B 23/06* (2013.01); *A47B 2220/0016* (2013.01)

(58) Field of Classification Search
CPC ..... A47B 23/043; A47B 23/06; A47B 2220/0016; A47B 19/002; A47B 23/00; A47B 23/04; A47B 23/044; A47B 97/04; A47C 11/34
USPC .... 248/459, 441.1, 444, 447, 448, 451, 454, 248/455, 457, 460, 461, 463, 452, 449
See application file for complete search history.

(56) References Cited

U.S. PATENT DOCUMENTS 489,518 A * 1/1893 Ambruster ..... A47B 23/042 248/448
2,165,255 A 7/1939 Hamilton
2,449,492 A * 9/1948 Long ..... A47B 23/043 248/454
3,136,082 A * 6/1964 Sloves ..... A45C 9/00 40/530
3,338,629 A * 8/1967 Drees ..... B60R 7/043 312/235.8
3,669,227 A * 6/1972 Alford ..... A47B 97/08 190/11
3,954,314 A * 5/1976 Crawford ..... A47B 97/04 312/231
4,047,309 A * 9/1977 Royko ..... A47B 41/02 434/419
4,294,348 A * 10/1981 Hastings ..... B25H 3/02 206/1.7
4,544,123 A * 10/1985 Peacock ..... G03B 21/30 206/45.24
4,886,231 A * 12/1989 Doerksen ..... A47B 23/043 248/455
5,067,682 A * 11/1991 Figaro ..... A47B 23/043 248/453

(Continued)

*Primary Examiner* — Nkeisha Smith
(74) *Attorney, Agent, or Firm* — Sanchelima & Associates, P.A.; Christian Sanchelima; Jesus Sanchelima

(57) ABSTRACT

A stationary supplies case including a case assembly and a stand assembly is disclosed. The case assembly includes a case which holds a slidable container within. The container houses and stores stationary supplies therein. Mounted to the front side of the case is a stand of the stand assembly. The stand assembly include a lower portion and lower portion which can be folded or unfolded. In the unfolded configuration the stand is able to maintain a book or the like displayed properly for ease of viewing. The stand is positioned at a predetermined angle with notches and a support arm that are located to the rear of the stand. The stationary supplies within the container are readily available to the user for annotating or the like to the book being viewed or displayed.

14 Claims, 8 Drawing Sheets

(56) References Cited

U.S. PATENT DOCUMENTS

| | | | | | |
|---|---|---|---|---|---|
| 5,393,029 | A * | 2/1995 | Senko | A47B 23/043 | 248/447 |
| 5,409,383 | A * | 4/1995 | Mannino | A45C 15/00 | 434/408 |
| 5,722,628 | A * | 3/1998 | Menaged | A47B 23/043 | 211/50 |
| 6,045,108 | A * | 4/2000 | Cziraky | A45C 9/00 | 248/454 |
| 6,540,192 | B2 * | 4/2003 | Ouellet | A47B 97/04 | 248/441.1 |
| 6,751,878 | B2 * | 6/2004 | Hamann | B43L 13/147 | 248/441.1 |
| 6,886,689 | B2 * | 5/2005 | Hohns | G11B 33/0444 | 206/308.3 |
| 6,925,739 | B1 * | 8/2005 | Cole | G09D 3/04 | 206/45.2 |
| 7,694,932 | B1 * | 4/2010 | Ngan | G09F 1/06 | 248/461 |
| 8,123,189 | B2 * | 2/2012 | Phifer | A47B 23/044 | 248/460 |
| 8,297,443 | B2 * | 10/2012 | Ogando | B65D 43/16 | 206/750 |
| 8,567,740 | B2 * | 10/2013 | Tarnutzer | B42D 9/00 | 248/456 |
| 9,578,979 | B1 * | 2/2017 | Zeuch | G09F 3/12 | |
| 2006/0081758 | A1 * | 4/2006 | Lee | G09F 15/0062 | 248/459 |

* cited by examiner

STATIONARY SUPPLIES CASE

II. BACKGROUND OF THE INVENTION

1. Field of the Invention

The present invention relates to a stationary supplies case and, more particularly, to a stationary supplies case that includes a stand for ease of viewing documents, books or the like.

2. Description of the Related Art

Several designs for stationary supplies case have been designed in the past. None of them, however, include a combination pencil case and book support comprising a container having a folding body which is erected to support a book or pad in an upright manner, where the underside of the book support has a non-slip surface. The present invention provides a multifunctional case that helps the user remain more organized. Thereby, also resulting in the user being able to be more efficient due to necessary tools being readily available with the present invention.

Applicant believes that a related reference corresponds to U.S. Pat. No. 4,886,231 for a foldable book stand. Applicant believes that another related reference corresponds with U.S. Pat. No. 2,165,255 for a book support. None of these references, however, teach of a supplies case and foldable stand in an ergonomic design that maintains all needed supplies readily available to the user while working with the document held upright with the foldable stand.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide a stationary supplies case that is multifunctional.

It is another object of the present invention to provide a stationary supplies case that is capable of holding reading material for viewing to the user.

It is also another object of this invention to provide a stationary supplies case that keeps supplies readily available to user even during work.

It is still another object of the present invention to provide a stationary supplies case that is readily portable.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE EMBODIMENTS OF THE INVENTION

Figure 1:
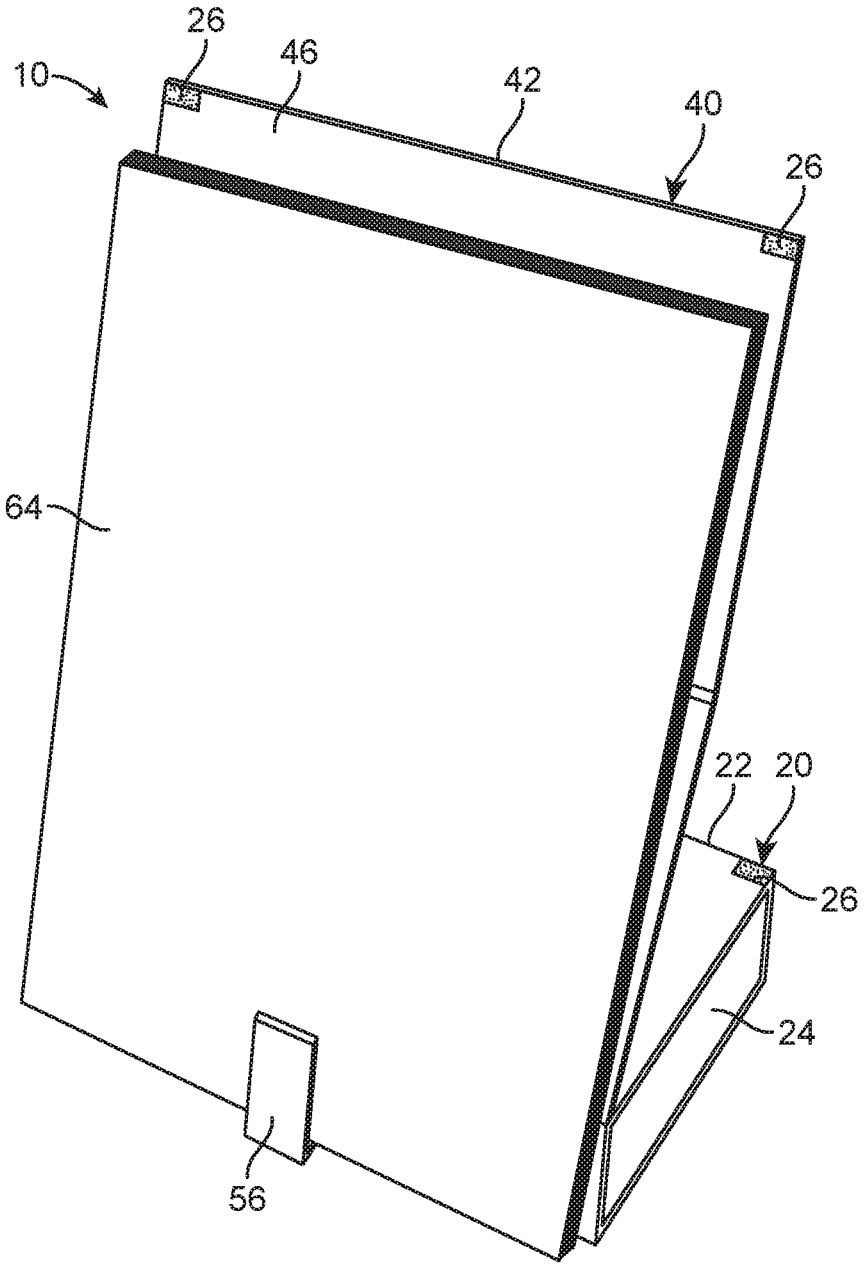
FIG. 1 represents an operational setting in which stationary supplies case 10 is being used to display a book 64.

Referring now to the drawings, where the present invention is generally referred to with numeral 10, it can be observed that it, a stationary supplies case 10, basically includes a case assembly 20 and a stand assembly 40.

Figure 2:
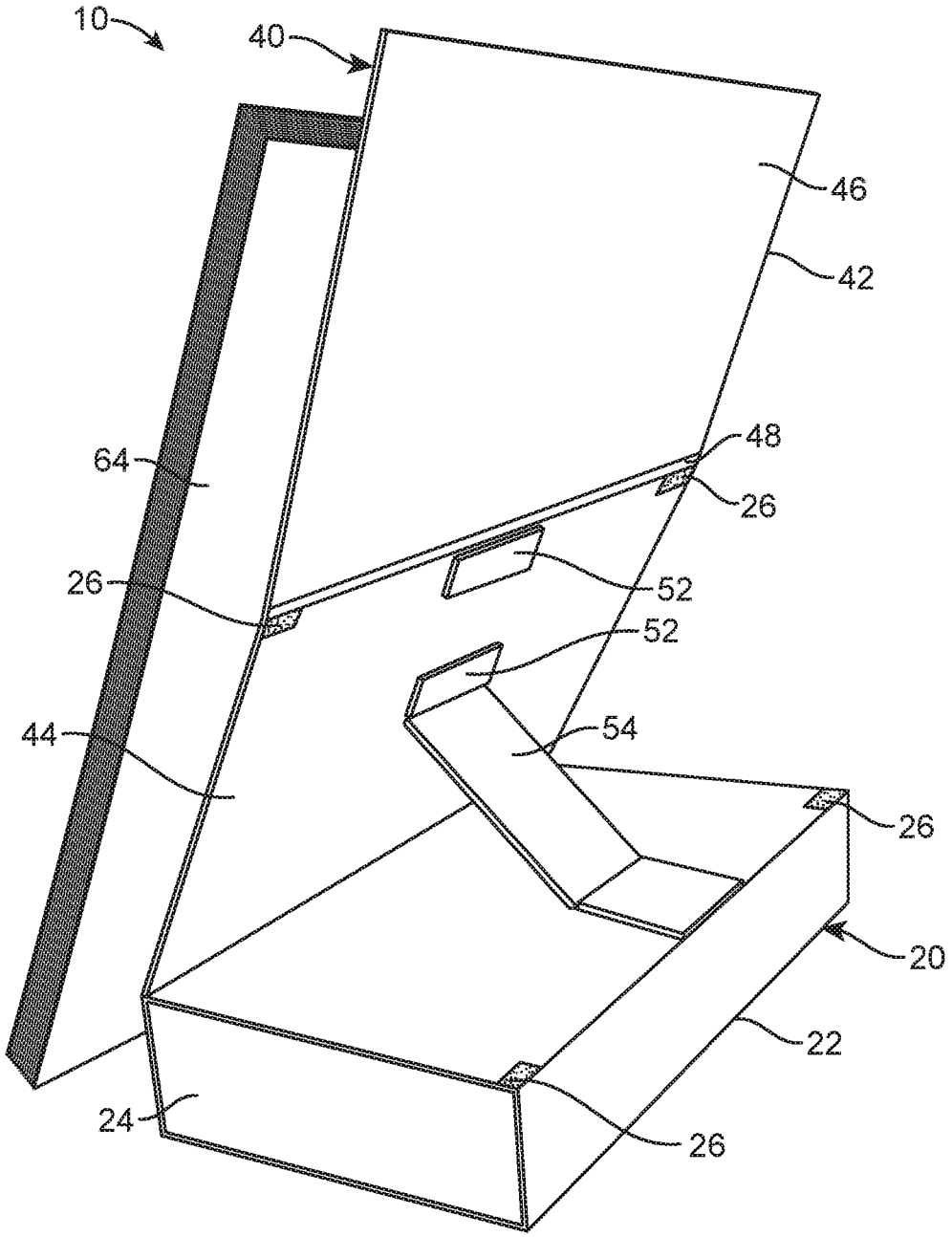
FIG. 2 represent a rear view of stationary supplies 10 is being used to display book 64.

As best seen in FIGS. 1 and 2, it can be seen that a stationary supplies case 10 can be used to store stationary supplies 62 and further display a book 64 for viewing, simultaneously. Stationary supplies 62 may include, pens, pencils, erasers, paintbrushes, paints, or the like as needed by a user. It is to be understood that book 64 may alternatively be a newspaper, document, canvas, magazine, mobile device or other materials that the user may need to display, read, or work on. It can be seen that book 64 may be erect upright for ease of accessing and reading. If content needs to be displayed horizontally, stationary supplies case 10 may suitably accommodate such need.

Case assembly 20, as best seen in FIG. 2, may be used to store and hold stationary supplies 62 within. It may be suitable for case assembly 20 to be made of materials such as cardboard, paper, metal, plastic, rubber, stainless steel or combinations thereof. Case assembly 20 may include a case 22. Case 22 may alternative be referred to as a housing. Case 22 may be rectangular, in the preferred embodiment. It is to be understood that other predetermined shapes may also be suitable for case 22. Case 22 may preferably be open on both distal ends. However, in an alternate embodiment, one distal end of case 22 may be sealed. It may be suitable for the bottom side of case 22 to include a non-slip surface as to prevent case sliding about a surface during usage. The non-slip surface may be of dimensions and a shape that cooperates with case 22. Case 22 may include a front edge 23 to which stand assembly 40 may be mounted thereto.

Importantly, housed within case 22 may be a container 24. Container 24 may alternatively be referred to as a drawer. Container 24 may be of a shape and dimensions that cooperate with case 22. In the preferred embodiment, container 24 may be rectangular with an open top face. Container 24 may preferably be received entirely within case 22. Container 24 may be slid in and out of case 22 through either of the open distal ends of case 22. Thereby resulting in container 24 having a closed and open configuration, as show in FIGS. 1 and 2, respectively. The user may push container 24 from one end to allow it to open on an opposite end of case 22. In one embodiment, container 24 may include a handle to allow pulling container 24 open. The handle may facilitate the opening and closing of container 24. Container 24 may preferably be used to store and carry stationary supplies 62 of the user, as best seen in FIG. 5.

Figure 3:
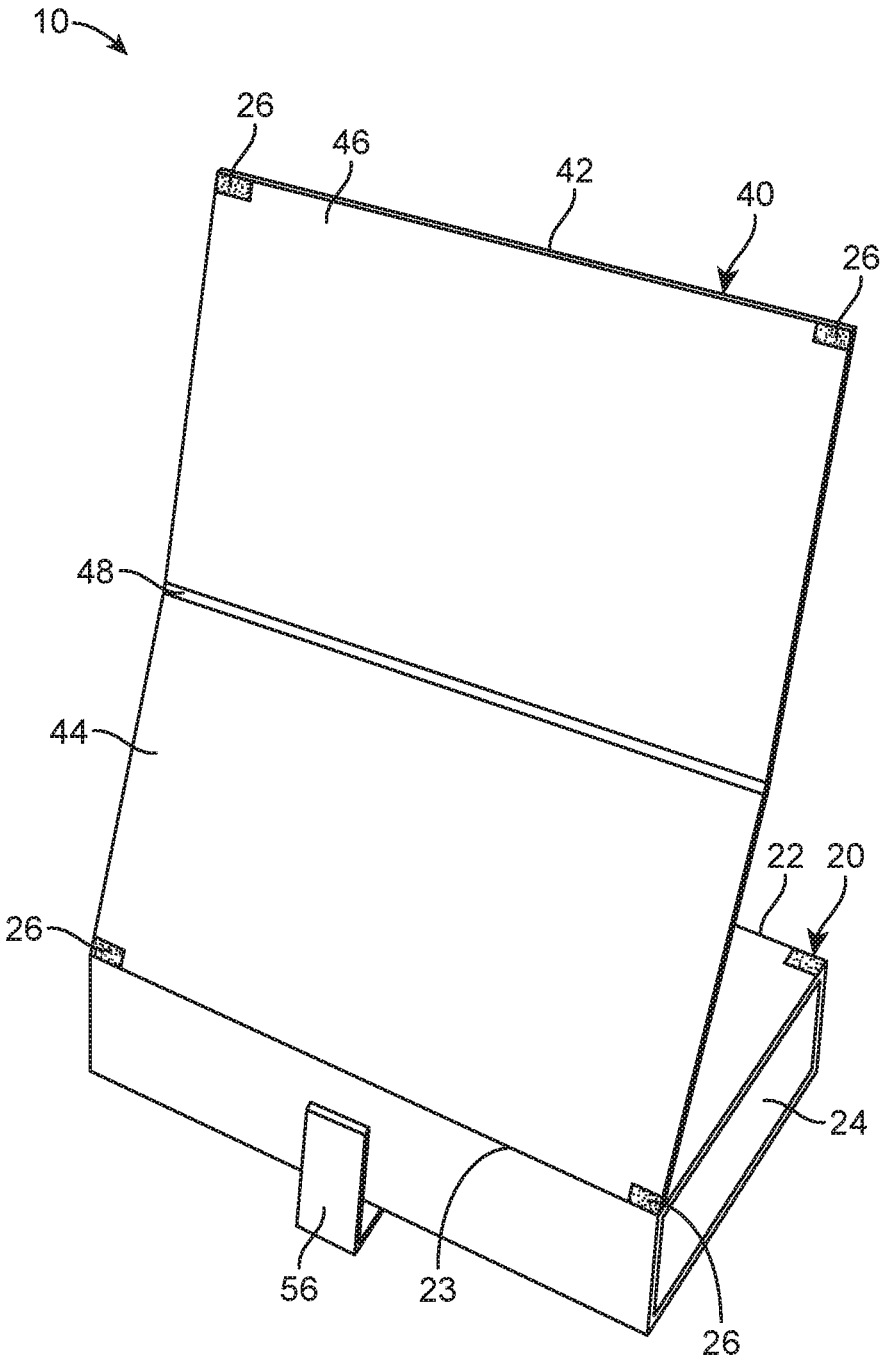
FIG. 3 shows an isometric view of stationary supplies case 10 in the unfolded configuration.
Figure 4:
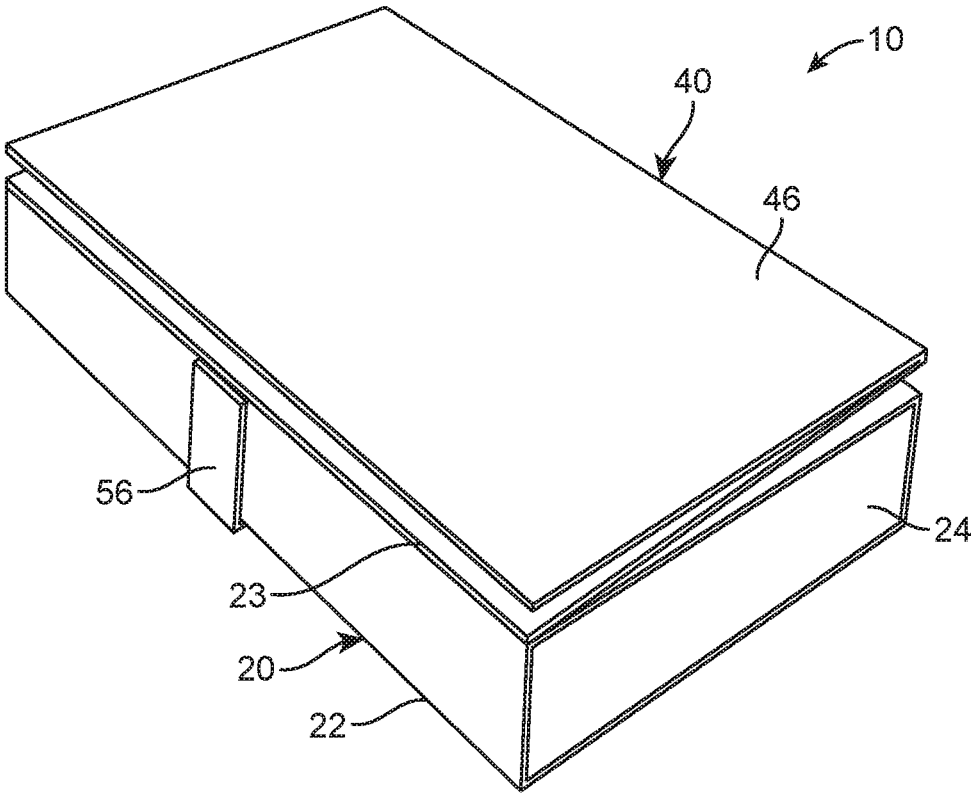
FIG. 4 illustrates an isometric view of stationary supplies case 10 in the folded configuration.
Figure 5:
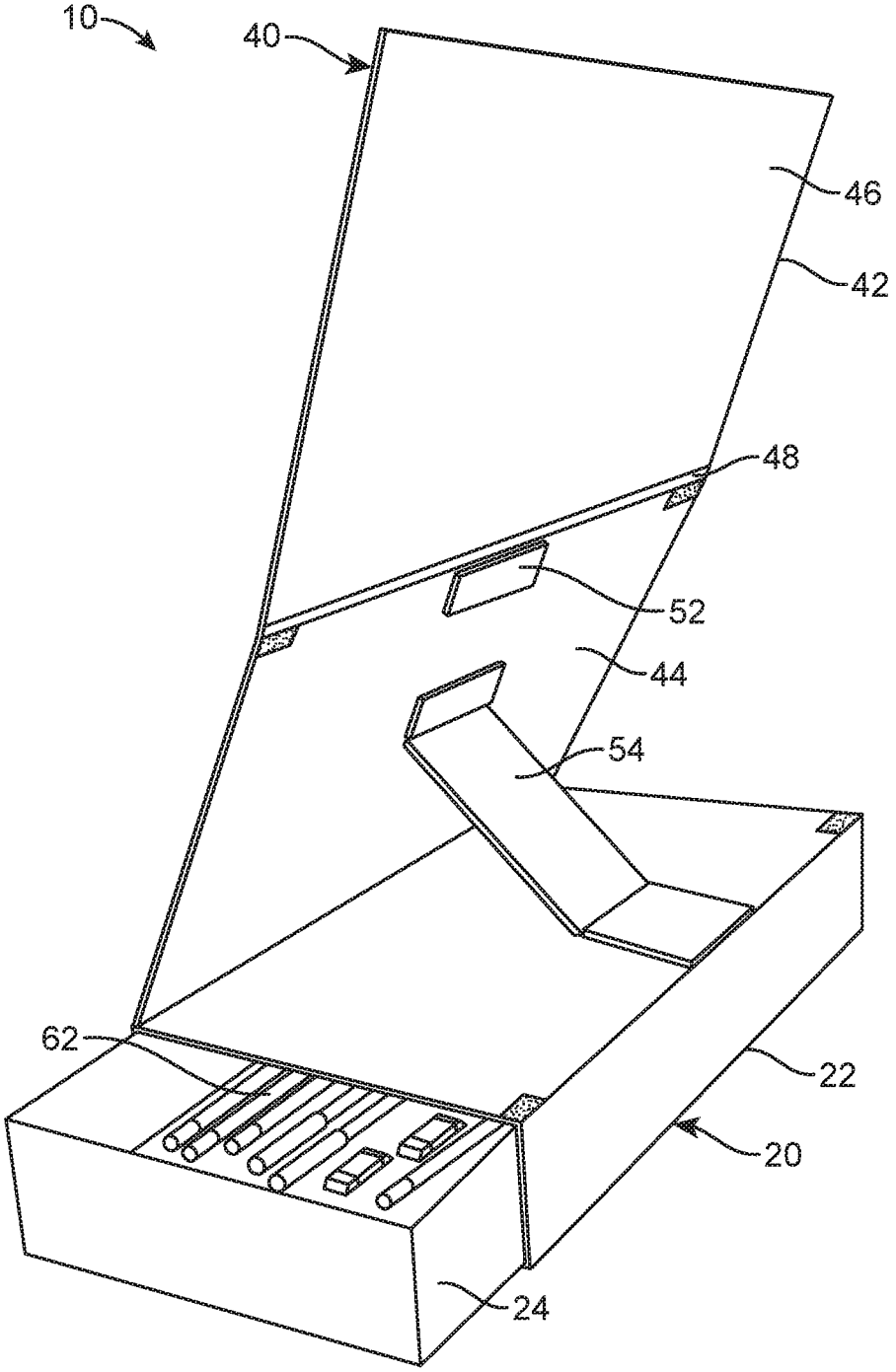
FIG. 5 is a representation of a rear view of the stationary supplies case 10 in the expanded configuration.
Figure 6:
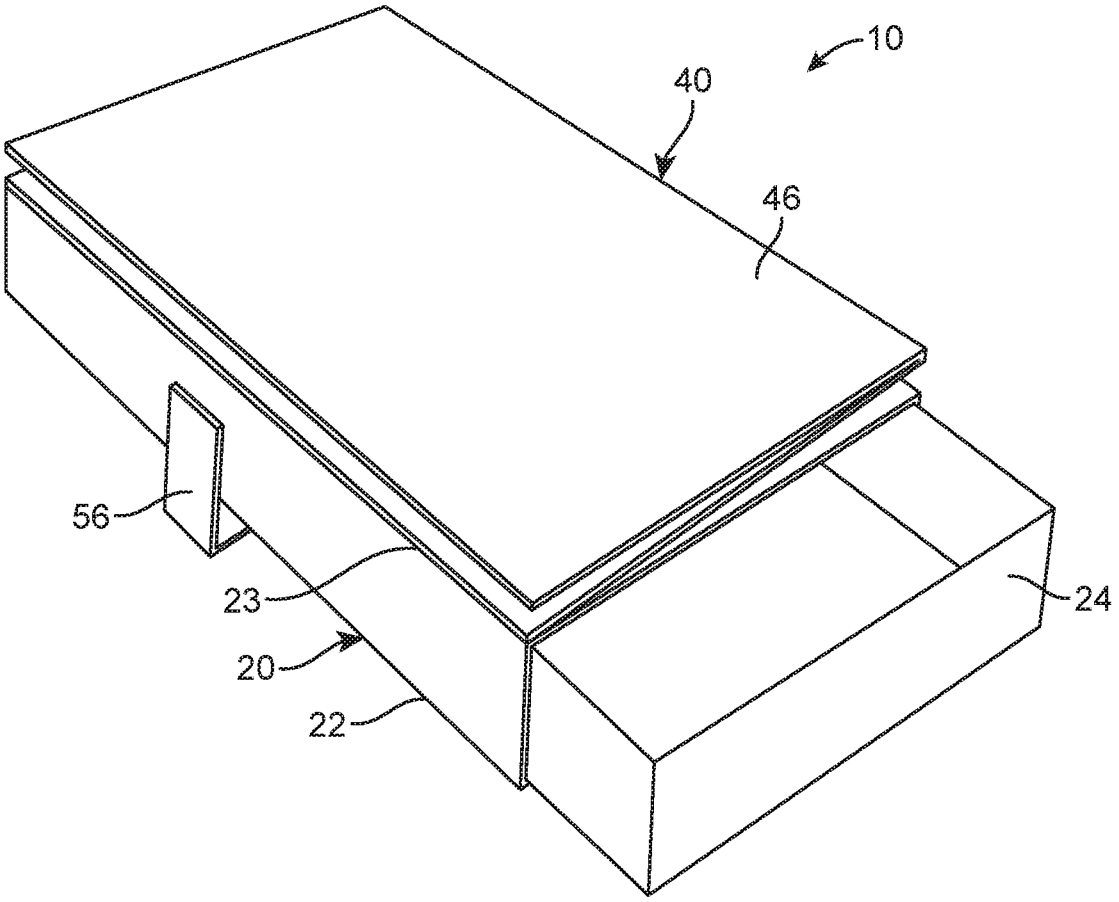
FIG. 6 represents an isometric view of case assembly 20 open and stand assembly 40 folded.
Figure 7:
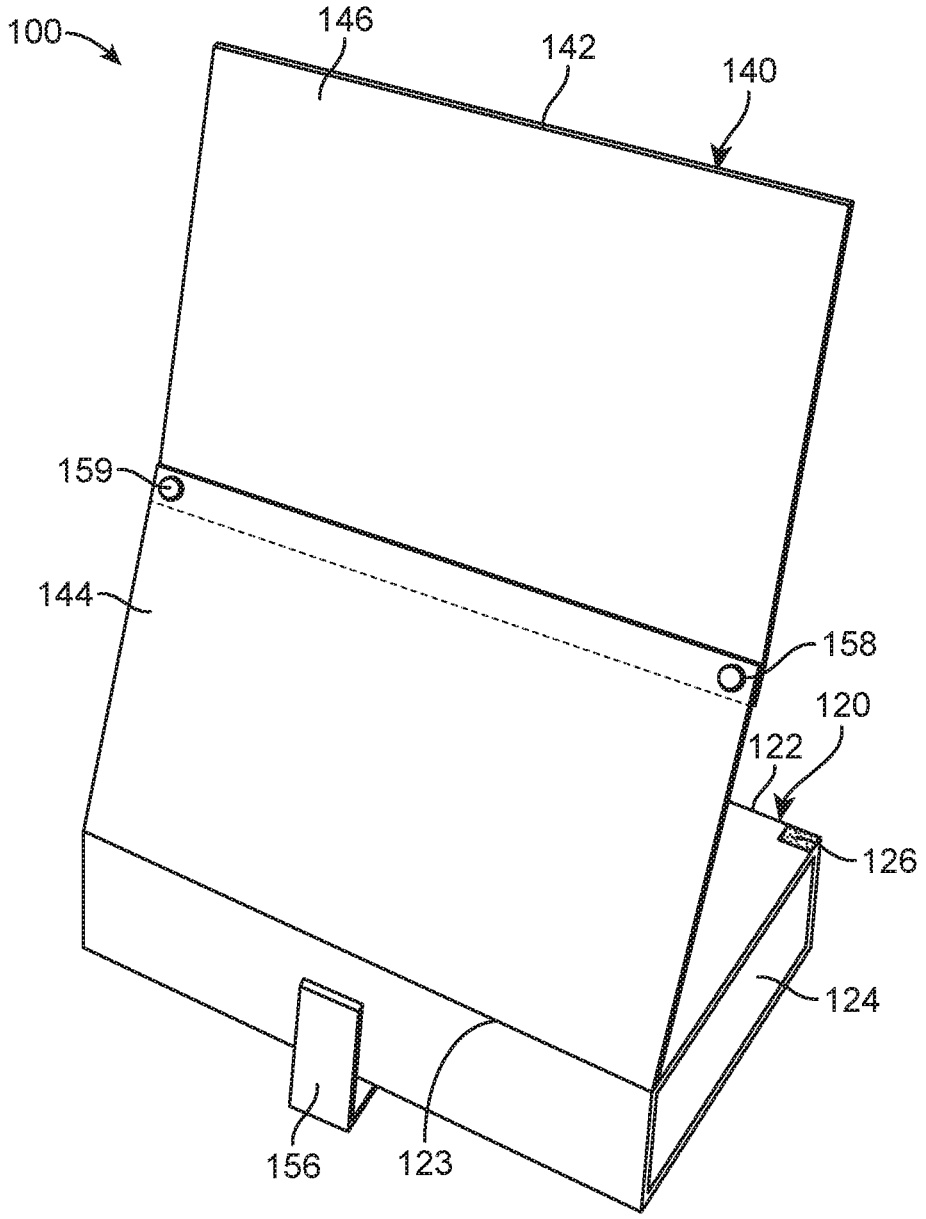
FIG. 7 shows an isometric view of stationary supplies case 100, an alternate embodiment.
Figure 8:
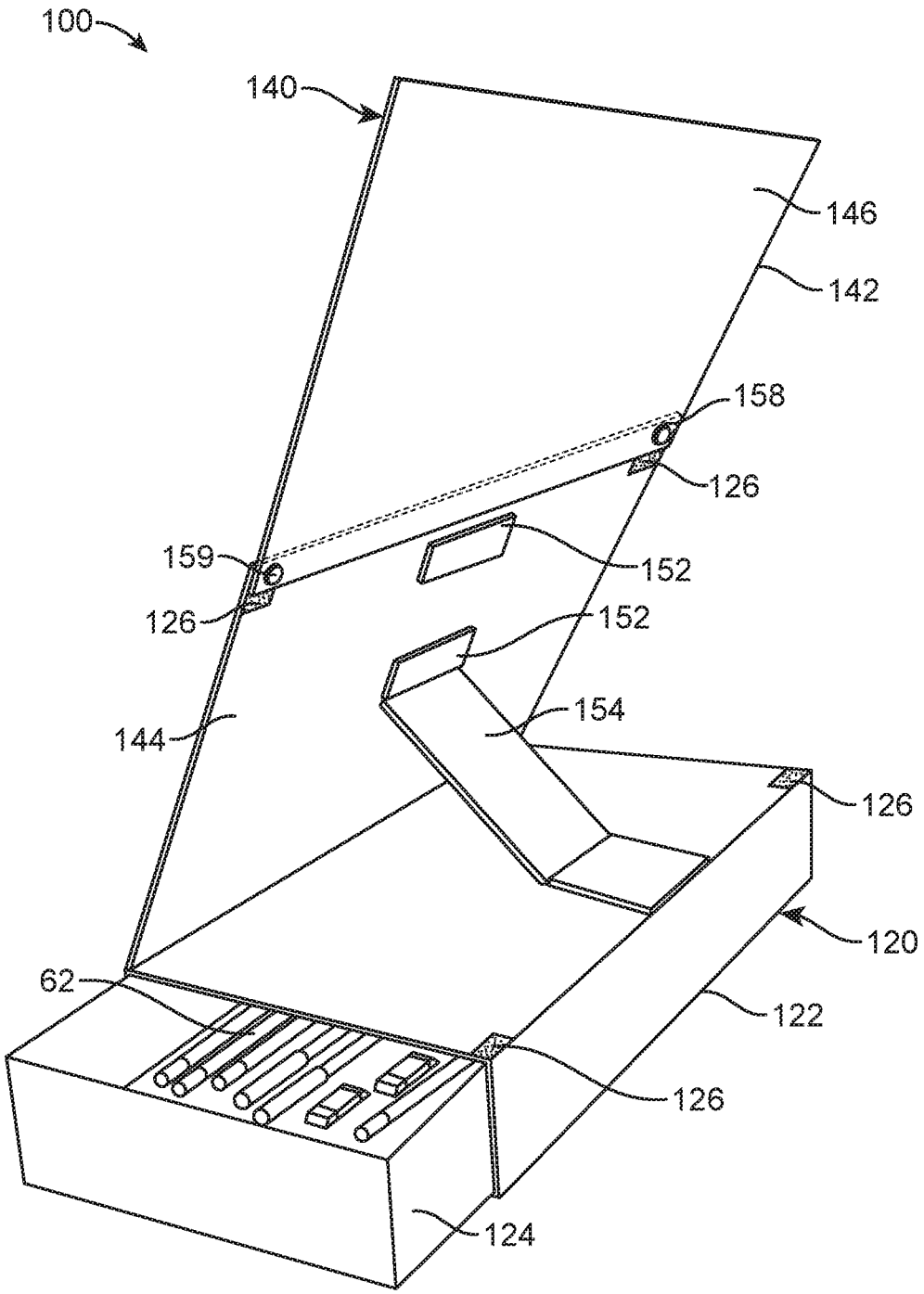
FIG. 8 illustrates a rear view of stationary supplies case 100, an alternate embodiment.

Mounted to case 22 may be stand assembly 40, as best seen in FIGS. 3-5. More specifically, stand assembly 40 may be mounted to front edge 23 of case 22. Stand assembly 40 may include a stand 42. Stand 42 may be mounted to front edge 23 of case 22. Stand 42 may be expanded to provide support to book 64 or the like. Book 64 may be in constant abutting contact with stand 42 when the present invention is in use. It is to be understood that stand 42 may have a folded and unfolded configuration. The folded configuration may be suitable when the present invention is stored or being transported. Stand 42 may be collapsible to be more ergonomic during transportation. The unfolded configuration may be suitable when the present invention is being used to support book 64 or the like. Stand 42 may preferably have a same length as case 22. Preferably, stand 42 may extend the entire length of case 22. Stand 42 may have a width greater than case 22, in the unfolded configuration.

Stand 42 may include folding portions defined as lower portion 44 and top portion 46. Lower portion 44 and top portion 46 may allow stand 42 to expand or collapse. Lower portion 44 may be the portion that is mounted to case 22 at front edge 23. It is to be understood that preferably, each of lower portion 44 and top portion 46 may each include a length and width that is the same as that of the top side of case 22. Lower portion 44 and top portion 46 may preferably be rectangular in shape, but other predetermine shapes and dimensions may be suitable as needed by the user. Lower portion 44 and top portion 46 may be adjacent to each other and in constant abutting contact with one another when stand 42 is in the unfolded configuration. Lower portion 44 and top portion 46 may be parallel to each other when stand 42 is in the unfolded configuration as well. Lower portion 44 and top portion 46 may be mounted atop of each other, horizontally, when stand 42 is in the folded configuration. Stand 42 include a crease 48 which allows stand 42 to collapse and further distinguishes lower portion 44 and top portion 46 from one another. Crease 48 may extend the entire length of both lower portion 44 and top portion 46, in the preferred embodiment. As best seen in FIG. 3, mounted at predetermined locations of case 22, lower portion 44 and top portion 46 may be fasteners 26. It is to be understood that fasteners 26 may correspond with each other. Fasteners 26 may help to keep lower portion 44 and top portion 46 secured together when in the folded configuration. Fasteners 26 may further help to maintain lower portion 44 and top portion 46 secured to case 22, in the folded configuration. More specifically, fasteners 26 may be located at a front face of lower portion 44 and top portion 46. Additionally, fasteners 26 may also be located at a rear face of lower portion 44 which may correspond with fasteners 26 located at a top face of case 22. It is to be understood that fasteners 26 may be hook and loop straps, snap buttons or other similar fastening and securing means.

As best seen in FIGS. 2 and 5, stand assembly 40 may include notches 52. Notches 52 may be mounted to a rear side of stand 42 as best shown in the aforementioned figures. More specifically, notches 52 may be mounted to a rear side of lower portion 44. Notches 52 may be rectangular shaped, in one embodiment. Notches 52 may extend outwardly and away from lower portion 44. Notches 52 may be spaced apart a predetermined distance. Preferably, notches 52 may be evenly spaced apart and parallel to each other. Stand assembly 40 may further include a support arm 54 which may cooperate with notches 52 to maintain stand 42 in the needed position. Support arm 54 may be mounted to the edge that is opposite to front edge 23 on case 22. Support arm 54 may extend diagonally towards notches 52. Support arm 54 may be mounted and lodged underneath notches 52 to angle stand 42 at a predetermined angle as needed by the user to achieve a desired viewing angle, as best seen in FIG. 2.

It may also be suitable for stand assembly 40 to include a holder 56. Holder 56 may be mounted to a front side of case 22. Holder 56 may be slidable to and away from case 22. In one embodiment, holder 56 may be L shaped. Holder 56 may include a front section that extends vertically. The front section may constantly be parallel to case 22. Holder 56 may help to maintain book 64 or other contents being held or displayed by the present invention in a proper upright position. In an alternate embodiment, holder 56 may include extension arms that extended at a predetermined angle to the lateral sides of holder 56, more specifically from the lateral sides of the front section. The extension arms may be in constant contact with the front section and be parallel to each other.

In an alternate embodiment, stationary supplies case 100 may include a case assembly 120 that is identical to case assembly 20. Case assembly 120 may include a case 122 with a container 124 slidably received therein. Case 122 may further include a front edge 123. Case assembly 120 may further include fasteners 126. Stationary supplies case 100 may further include a stand assembly 140 that includes similar previously mentioned components of stand assembly 40. The distinction being that stand assembly 140 operates and functions differently. Stand assembly 140 may include a stand 142 with a lower portion 144 and a top portion 146. At a rear side of lower portion 144 may be notches 152 that cooperate with a support arm 154 for adjusting stand 142 at the desired viewing angle. Additionally, stand assembly 140 may include a holder 156. Stand assembly 140 may operate by having top portion 146 be slidable out from lower portion 144. Top portion 146 may slide out of lower portion 144 to provide the needed height for stand 142. Lower portion 144 may include at least one opening 158 on the lateral sides thereof. At least one opening 158 may preferably be circular. Top portion 146 may include at least one push button 159 that cooperates with at least one opening 158. Such that when top portion 146 is pulled out of lower portion 144, top portion extends until at least one push button 159 is received and held by at least one opening. At least one push button 159 may prevent top portion from being pulled beyond the limits that are set by at least one opening 158. Thereby allowing book 64 to be displayed and viewed. At least one push button 159 may be pushed inwardly and recessed when top portion 146 in retracted and received within lower portion 144. Mounted at predetermined locations of case 122 and lower portion 144 may be fasteners 126. It is to be understood that fasteners 126 may correspond with each other. Fasteners 126 may help to keep lower portion 144 with top portion 146 within secured to case 122, in the folded configuration.

The present invention assists the user in being able to display book 64 for reading and viewing. Additionally, the present invention allows for providing stationary supplies 62 readily available to the user. This allows the user to annotate book 64 as book 64 is being read. The present invention is multifunctional. Stationary supplies case 10 facilitates organization and readily availability of station supplies 62.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A stationary supplies case, comprising:

a. a case assembly including a case, a container being slidably received within said case, stationary supplies being stored and received within said container; and b. a stand assembly including a stand, said stand mounted to said case, said stand having a folded and unfolded configuration, said stand erects and supports a book in an upright manner, said book being in constant abutting contact with said stand, wherein said stand includes a lower portion and a top portion, wherein said lower portion and said top portion include a crease therebetween, said crease allowing said stand to fold along said crease.

2. The stationary supplies case of claim 1, wherein said stand is mounted to a front edge of said case.

3. The stationary supplies case of claim 1, wherein said container has a closed and opened configuration.

4. The stationary supplies case of claim 1 wherein said lower portion and top portion are adjacent to each other, said lower portion and said top portion being in constant abutting contact with each other, said lower portion and said top portion being parallel to each other.

5. The stationary supplies case of claim 1 wherein said lower portion includes notches on a rear side thereof.

6. The stationary supplies case of claim 5, wherein said notches are evenly spaced apart and parallel to each other.

7. The stationary supplies case of claim 5, wherein a support arm extends from underneath one of said notches diagonally towards an edge of said case, said notches and support arm angling said stand at a predetermined angle.

8. The stationary supplies case of claim 1, wherein a holder extends outwardly and away from said case on a front side thereof, said holder being slidable.

9. The stationary supplies case of claim 8, wherein said holder includes a front section that extends vertically and is parallel to said case.

10. The stationary supplies case of claim 1 wherein said lower portion and said top portion are of a same dimension and shape as a top side of said case.

11. The stationary supplies case of claim 1, where an underside of said case includes a non-slip surface.

12. The stationary supplies case of claim 1, wherein fasteners are mounted onto said lower portion, said top portion and said case, said fasteners maintaining said lower portion, said top portion and said case secured together in the folded configuration.

13. A stationary supplies case, comprising:

a. a case assembly including a case, a container being slidably received within said case, stationary supplies being stored and received within said container, said container has an open and closed configuration; and b. a stand assembly including a stand, said stand mounted to a front edge of said case, said stand having a folded and unfolded configuration, said stand including a lower portion and a top portion, said lower portion and top portion are adjacent to each other, said lower portion and said top portion being in constant abutting contact with each other, said lower portion and said top portion being parallel to each other, said lower portion and said top portion including a crease therebetween, said crease extending the entire length of said stand, said lower portion includes notches on a rear side thereof, said notches are evenly spaced apart and parallel to each other, a support arm extends from underneath one of said notches diagonally towards an edge of said case opposite to said front edge, said notches and support arm angling said stand at a predetermined angle, a holder extends outwardly and away from said case on a front side thereof, said holder being slidable, said holder includes a front section that extends vertically and is parallel to said case, said stand erects and supports a book in an upright manner, said book being in constant abutting contact with said stand, fasteners mounted onto said lower portion and said case, said fasteners maintaining said lower portion with said top portion within secured onto said case in the folded configuration, said lower portion lying flat atop of said case with said fasteners.

14. A stationary supplies case, comprising:

a. a case assembly including a case, a container being slidably received within said case, stationary supplies being stored and received within said container, said container has an open and closed configuration; and b. a stand assembly including a stand, said stand mounted to a front edge of said case, said stand including a lower portion and a top portion, said top portion being slidable in and out of said lower portion, said lower portion includes at least one opening along lateral sides thereof, said top portion include at least one push button that cooperate with said at least one opening to maintain said top portion in place when slid out of said lower portion, said at least one push button protruding outwardly from said at least one opening, said lower portion including notches on a rear side thereof, said notches are evenly spaced apart and parallel to each other, a support arm extends from underneath one of said notches diagonally towards an edge of said case opposite to said front edge, said notches and support arm angling said stand at a predetermined angle, a holder extends outwardly and away from said case on a front side thereof, said holder being slidable, said holder includes a front section that extends vertically and is parallel to said case, said stand erects and supports a book in an upright manner, said book being in constant abutting contact with said stand, fasteners mounted onto said lower portion, said top portion and said case, said fasteners maintaining said lower portion, said top portion and said case secured together in the folded configuration.

* * * * *